US007685796B2

(12) United States Patent
Capelli et al.

(10) Patent No.: US 7,685,796 B2
(45) Date of Patent: Mar. 30, 2010

(54) MACHINE AND PROCESS FOR CLOSING CONTAINERS

(75) Inventors: Stefano Capelli, Erbuso (IT); Piero Bielli, Canelli (IT)

(73) Assignee: AROL SpA, Canelli (Asti) (IT)

( * ) Notice: Subject to any disclaimer, the term of this patent is extended or adjusted under 35 U.S.C. 154(b) by 554 days.

(21) Appl. No.: 11/560,194

(22) Filed: Nov. 15, 2006

(65) Prior Publication Data

US 2007/0107384 A1 May 17, 2007

(30) Foreign Application Priority Data

Nov. 16, 2005 (EP) ..... 05425810

(51) Int. Cl.
*B65B 31/00* (2006.01)

(52) U.S. Cl. ..... 53/510; 53/283; 53/266.1; 53/269; 53/432

(58) Field of Classification Search ..... 53/432, 53/431, 79, 80, 81, 88, 131.3, 287, 510, 269, 53/266.1, 282, 283
See application file for complete search history.

(56) References Cited

U.S. PATENT DOCUMENTS 2,798,842 A * 7/1957 Rampino ..... 208/199
2,876,787 A * 3/1959 Gibson ..... 137/101.11
3,477,192 A * 11/1969 Brown et al. ..... 53/432
5,114,670 A * 5/1992 Duffey ..... 422/24
5,299,408 A * 4/1994 Dupont ..... 53/432
5,896,727 A * 4/1999 Egli et al. ..... 53/426
6,351,924 B1 * 3/2002 Gustafsson et al. ..... 53/425
6,457,299 B1 * 10/2002 Schwenke et al. ..... 53/510
6,964,197 B2 * 11/2005 Davis et al. ..... 73/700
2005/0028487 A1 2/2005 Winters et al.

FOREIGN PATENT DOCUMENTS

DE 199 11 517 9/2000
EP 0 457 747 11/1991
EP 1 375 412 1/2004

OTHER PUBLICATIONS

European Search Report, Application No. 05425810.8-2316, Dated May 17, 2006.

* cited by examiner

*Primary Examiner*—Sameh H. Tawfik
(74) *Attorney, Agent, or Firm*—Patterson & Sheridan, L.L.P.

(57) ABSTRACT

Automatic machine for closing containers, including an automatic corking unit, a conveyor including an inlet section for feeding containers to be corked towards the automatic corking unit and an outlet section for moving apart the corked containers from the corking unit, an injection unit arranged upstream of the corking unit, arranged for injecting inert gas in the head portions of the containers to be corked, a casing defining a chamber which contains the injection unit and the corking unit and a feeding system of inert gas for maintaining within said chamber an inert gas atmosphere.

7 Claims, 6 Drawing Sheets

MACHINE AND PROCESS FOR CLOSING CONTAINERS

CROSS-REFERENCE TO RELATED APPLICATIONS

This application claims benefit of European Patent Application Number 05425810.8, filed Nov. 16, 2005, which is herein incorporated by reference.

BACKGROUND OF THE INVENTION

Field of the Invention

The present invention relates to a machine and a process for closing containers, in particular for the corking of bottles.

The present invention is applicable to closing systems using caps of any type, such as for example corks, crown caps, screw caps, etc.

The present invention has been particularly developed for corking bottles of sparkling wines. The invention, however, is not limited to this specific application field and can be generally used for corking bottles and containers containing any kind of product.

In the field of the corking of wines, there is the problem of the oxygen of the air existing in the head portion of the bottles. The oxygen which remains trapped to the top of the bottleneck after the application of the cork causes an oxidation process which involves a loss of the organoleptic characteristics of the wine. This oxidation process is especially harmful in case of wines particularly valuable which should preferably maintain intact their characteristics also for many years.

To the wines intended for the bottling, in order to reduce the problems resulting from the oxidations and the development of aerobic bacteria caused by the oxygen existing in the head space of the bottle, it is a current practice to add sulfur dioxide or other chemical additives. Recently, the effects on the human health by the use of these sulfur-based compounds have been especially discussed. The regulations of some countries impose to show on the label of the product the presence of sulfur derivatives, and a possible evolution of the regulation in defense of the consumer in the near future could foresee the obligation of showing the quantity of sulfur compounds existing in the wine.

In view of the above, the producers of high quality wines have a great interest in developing corking processes which allow to reduce the use of the above chemical additives.

Corking systems which foresee the suction of the air existing in the head portions of the bottles before the application of the cork are already known.

Such systems can not be used, however, for the corking of sparkling wines as the suction of the air from the bottle would inevitably cause a loss of effervescence, which is one of the most important qualities of a valuable sparkling wine.

Therefore, for the sparkling wines the suction of air before the corking is not carried out, but sometimes the injection of an inert gas, typically nitrogen, is used before the corking. The injection systems of inert gas of the known type have however a very reduced efficiency concerning the reduction of the oxygen contained in the bottles after the corking.

The poor efficiency of the injection systems of inert gas of the known type does not allow a substantial reduction of the quantity of sulfur-based additives which must be added on bottling.

SUMMARY OF THE INVENTION

The aim of the present invention is to provide a corking machine and a process which allow to overcome the drawbacks above stated. In particular, the aim of the present invention is to provide a corking machine and a process which allow to obtain a substantial reduction of the oxygen existing in the bottles and which, in the particular case of corking of sparkling wines, do not involve a loss of carbon dioxide and therefore of the effervescence.

According to the present invention, such aim is attained by a machine and a corking process having the features forming the object of the claims.

BRIEF DESCRIPTION OF THE DRAWINGS

The present invention will now be described in further detail with reference to the enclosed drawings, which are given by mere way of not limitative example, wherein.

DETAILED DESCRIPTION

Figure 1:
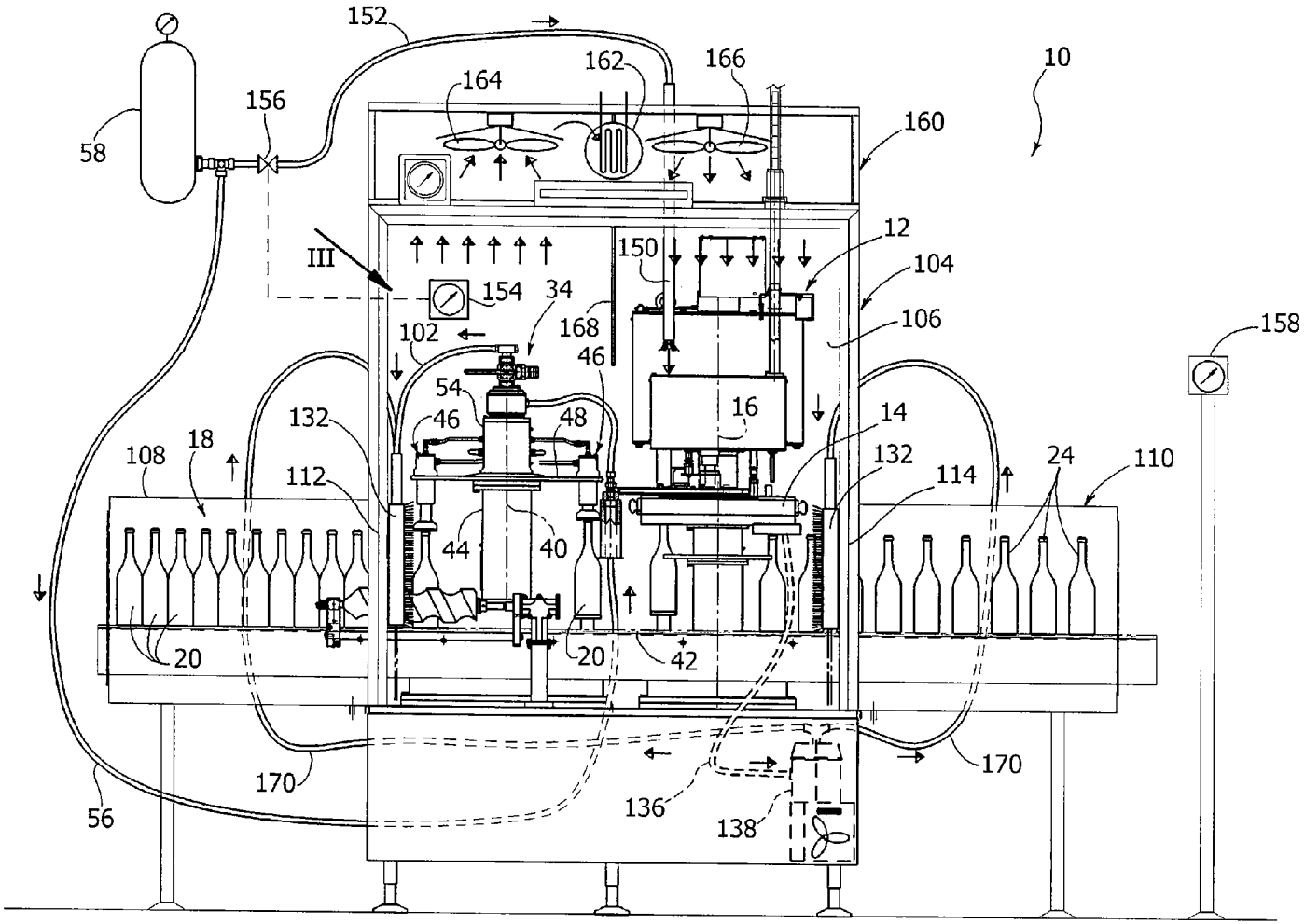
FIG. 1 is a diagrammatic elevational view of a corking machine according to the present invention.
Figure 2:
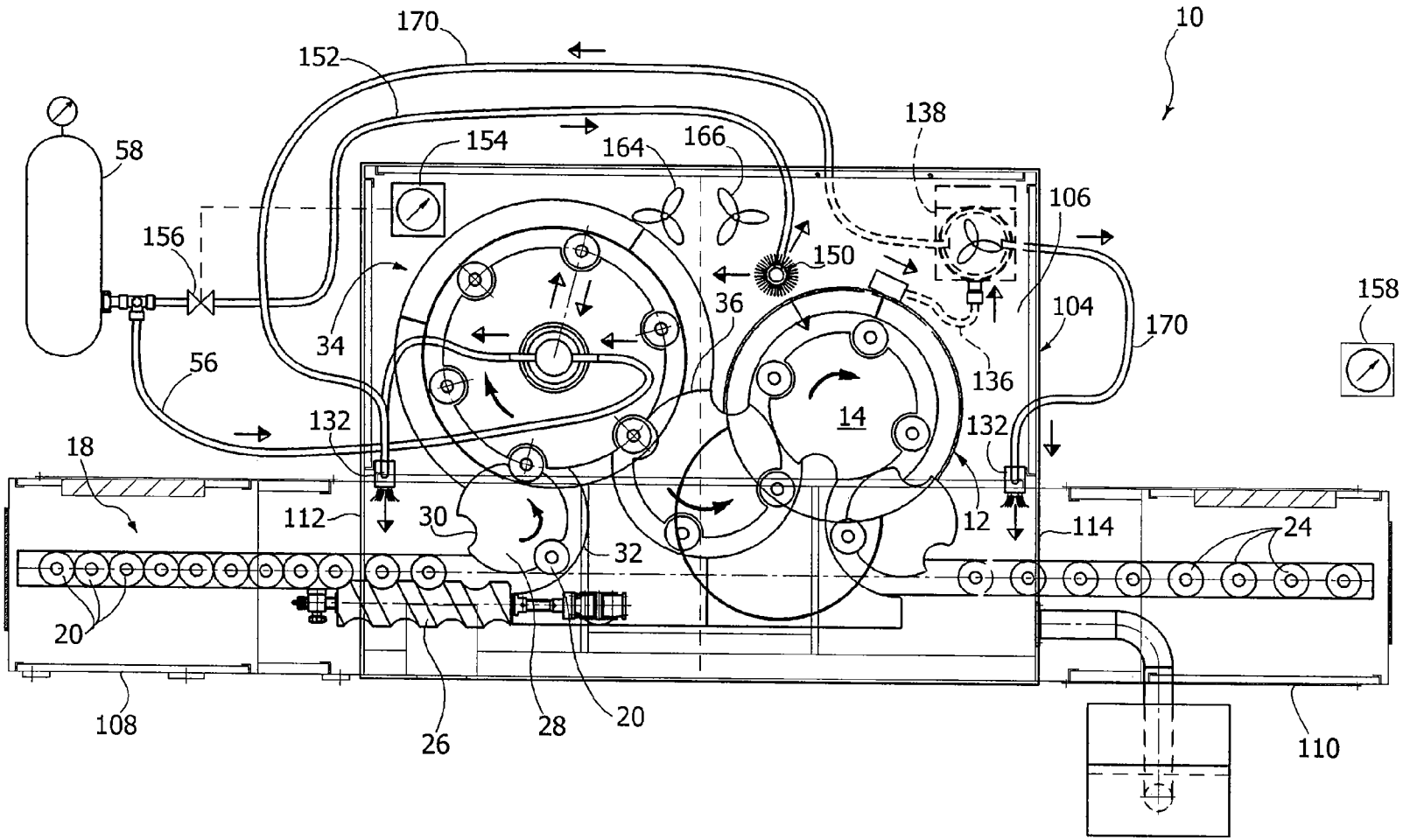
FIG. 2 is a plan view of the machine of FIG. 1.

Referring to FIGS. 1 and 2, an automatic bottling machine according to the present invention is shown by 10. The machine 10 includes an automatic corking unit 12 which can be of any commercially available type. In particular, the corking unit 12 could be of the type suitable for applying corks, crown caps, screw caps, etc. The corking unit 12 is preferably of the carousel type, with a plurality of corking heads carried by a structure 14 rotating around a vertical axis 16, but can also be monohead.

The structure and the functioning of the automatic corking unit 12 are not described in detail since, as previously said, the corking unit can be of any known type and its features are well known to a skilled in the art.

The bottling machine 10 includes a conveyor having an inlet section 18 for the feeding of bottles to be corked 20 towards the corking unit 12 and an outlet section 22 for the exit of the corked bottles 24. The conveyor 18, 22 is of the belt-type, usually employed in the bottling sector, which transports continuous arrays of bottles 20, 24 vertically oriented.

In correspondence with the end part of the inlet section 18 of the conveyor, a screw-conveyor device 26 is placed, which spaces apart the bottles to be corked 20 and feeds them to a first transfer wheel 28 (FIG. 2) rotatable around a vertical axis and equipped with seats 30 for gripping the bottles 20. The wheel 28 is associated with a curved-shaped stationary guide 32 which defines a guide path for the bottles 20.

The bottling machine 10 includes an injection unit 34 arranged upstream of the corking unit 12. The injection unit 34, which can also be mono-head, picks up the bottles to be corked 20 from the wheel 28 and, after an injection of inert gas, sends the bottles to be corked to the corking unit 12 through a second transfer wheel 36.

Figure 3:
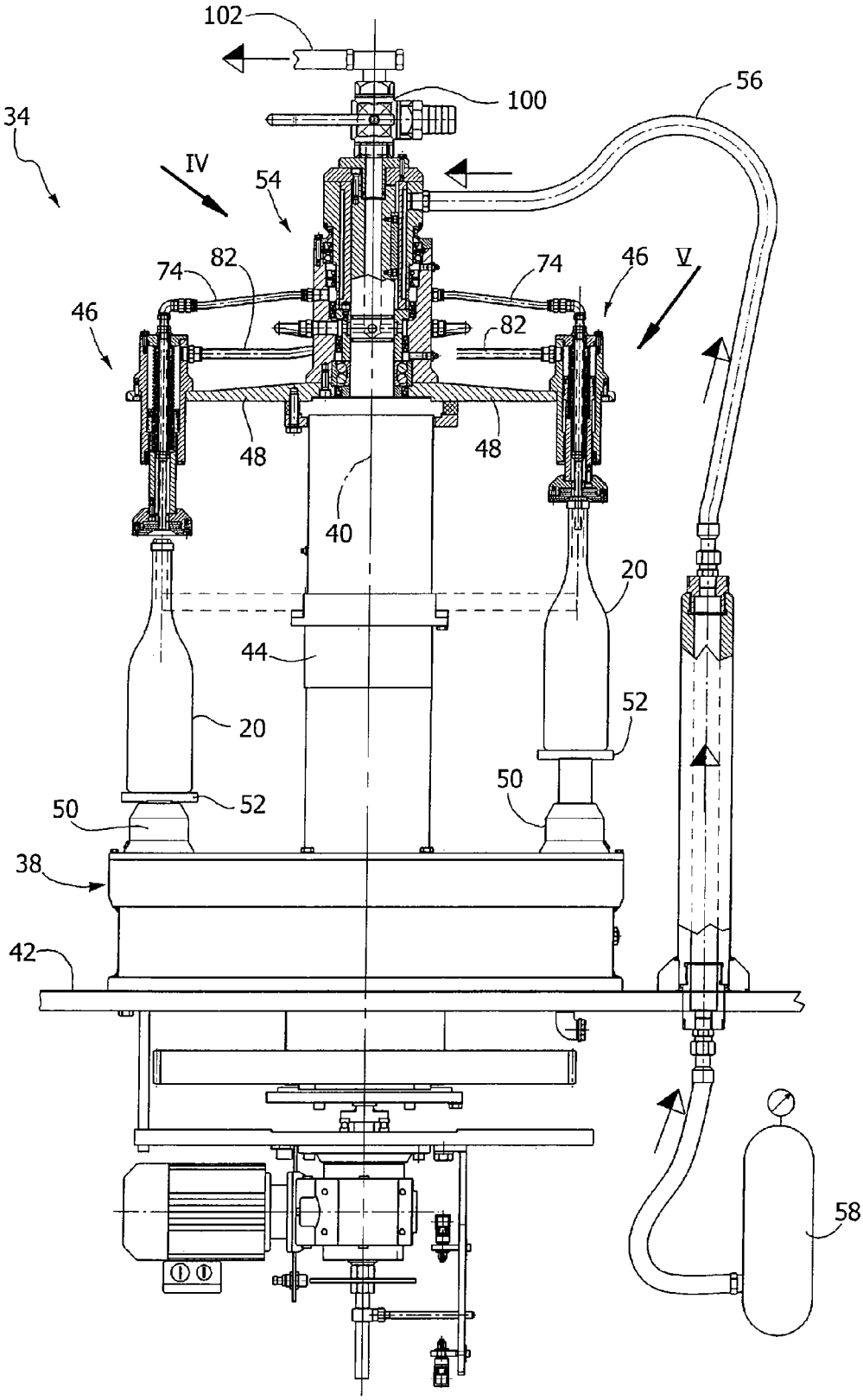
FIG. 3 is a view in a greater scale and partially cut-away of the part shown by the arrow III of FIG. 1, FIGS. 4 and 5 are sections in greater scale of the parts shown by the arrows IV and V, respectively, in FIG. 3.

Referring to the FIG. 3, the injection unit 34 includes a rotatable support 38 which is carried in a rotatable way around a vertical axis 40 by a stationary support plane 42 of the machine 10. The rotating support 38 carries a rotating central hub 44 to which a plurality of injection heads 46, spaced apart in the circumferential direction, are connected. The injection heads 46 are connected to the central hub 44 through a disk structure 48.

The rotating support 38 carries a plurality of bottle supports 50, each of which is placed in correspondence with a respective injection head 46. Each bottle support 50 includes a small plate 52 vertically moving, on which, in use, a respective bottle to be corked 20 is abutting.

Always referring to the FIG. 3, the injection unit 34 includes a distribution manifold 54 arranged co-axially to the rotating hub 44. The distribution manifold 54 is connected through a stationary tube 56 to a source of pressure inert gas, shown by 58. The inert gas can be any gas which is inert to the product contained in the bottles 20. A typical inert gas can be, for example, nitrogen. Otherwise, other gases or gas mixtures free of oxygen can be used. The inert gas, for example nitrogen, is contained in high pressure cylinders equipped with pressure-reducer valves. The distribution manifold 54 feeds the flow of inert gas to the single injection heads 46 in the way that will be described hereinafter.

Figure 5:
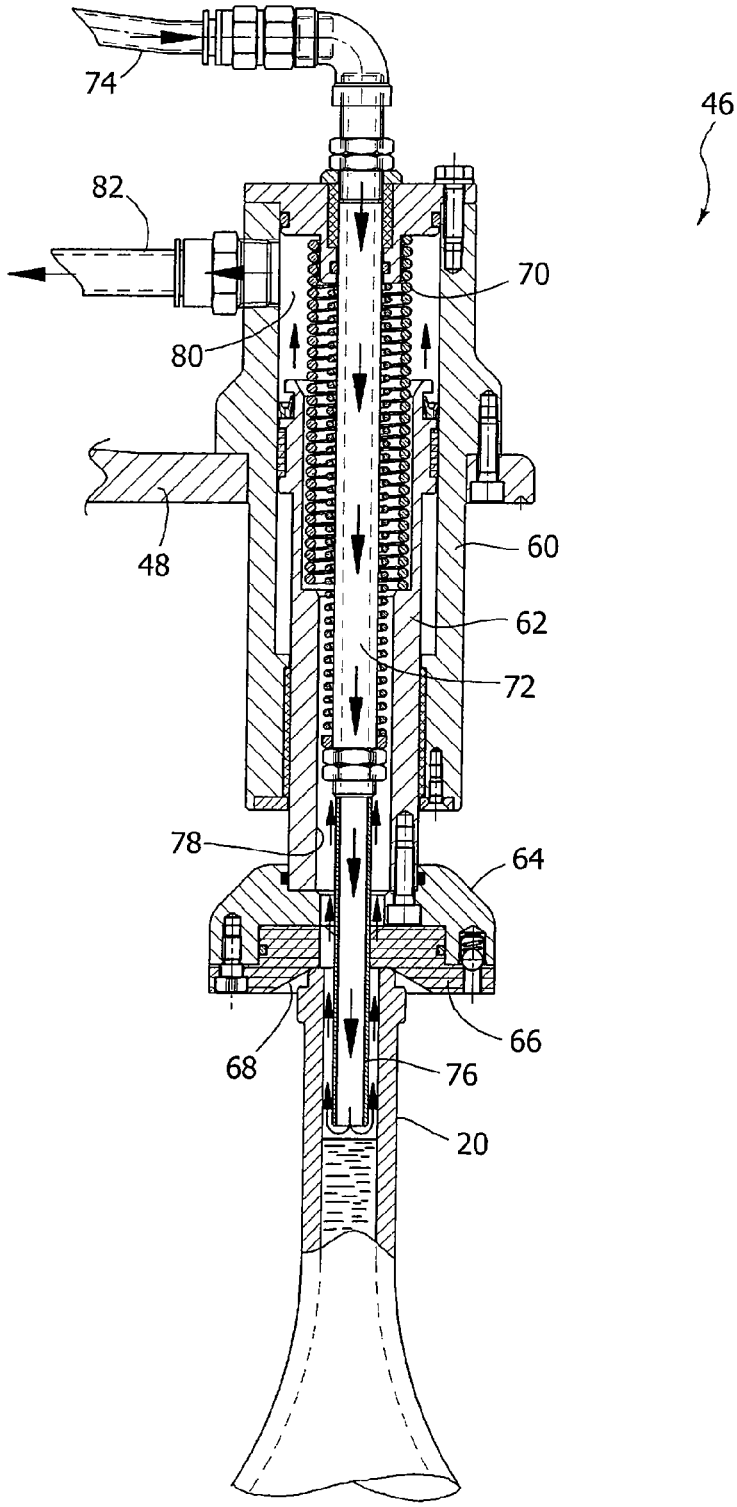

Referring to the FIG. 5, each injection head 46 includes an outer body 60 fixed with respect to the structure 48. Inside the body 60 a sleeve 62 is slidably mounted in the vertical direction, which carries at its lower end a centering element 64 including a plastic body 66 with a conical centering surface 68 which is intended for abutting with a seal contact against the head surface of a bottle 20. The sleeve 62 is elastically urged downwards by a compression coil spring 70.

Each injection head 46 includes an injection tube 72 fixed with respect to the outer body 60 and extending within the sliding sleeve 62. The injection tube 72 has an upper end connected to a feeding tube 74 of inert gas. The injection tube 72 ends with a cannula 76 whose lower end fits into the head portion of a bottle 20. The lower end of the cannula 76, in use, is arranged at a distance of about 20 mm from the upper level of the liquid contained in the bottle 20.

Always referring to FIG. 5, the sliding sleeve 62 has an inner cavity 78 which constitutes a conduit for exiting the return gas flow. The conduit 78 communicates on the top with a chamber 80 formed at the top of the outer body 60 and communicating with a vent tube 82.

In FIG. 5, the arrows show the direction of the inert gas flow in each injection head 46. The delivery of the inert gas flow starts when the head portion of the bottle 20 is pressed against the conical surface 68 of the centering element 64. The spring 70 ensures a pressure contact between the surface 68 and the upper end of the bottle 20. The inert gas flows from the lower end of the cannula 76 and produces a return flow shown by the arrows directed upwards. This return flow removes the air contained in the head portions of the bottles 20. The air and the inert gas leave the head portion of the bottle 20 and reach the chamber 80 through the conduit 78. The return flow is drawn from the injection head 46 through the conduit 82. By mere way of example, the injection pressure of the inert gas (gage pressure) is set on values in the order of 2,5 bars, with an average flow rate per nozzle in the order of 15 NI/1'. The duration of the injection of inert gas could be, for example, in the order of about 4 seconds per bottle. For the normal bottles of wine, the injection cannula 76 has an outer diameter in the order of 11 mm and an inner diameter of about 8,5 mm.

The injection of inert gas in the head portion of the bottle causes a substantial removal of the air (and therefore the oxygen) present in the head portion of the bottle. At the same time, a reduction of the oxygen dissolved in the liquid contained in the bottle is obtained as well. It is estimated that in a bottle of sparkling wine of 750 ml, whose headspace is equal to 25 ml (total capacity of the bottle of 775 ml) the enrichment in the total oxygen after the corking is about 3,0 mg/l. After the injection of inert gas in the injection unit according to the present invention, the quantity of total oxygen existing in the bottle is reduced on average to about 0,5 mg/l.

Figure 4:
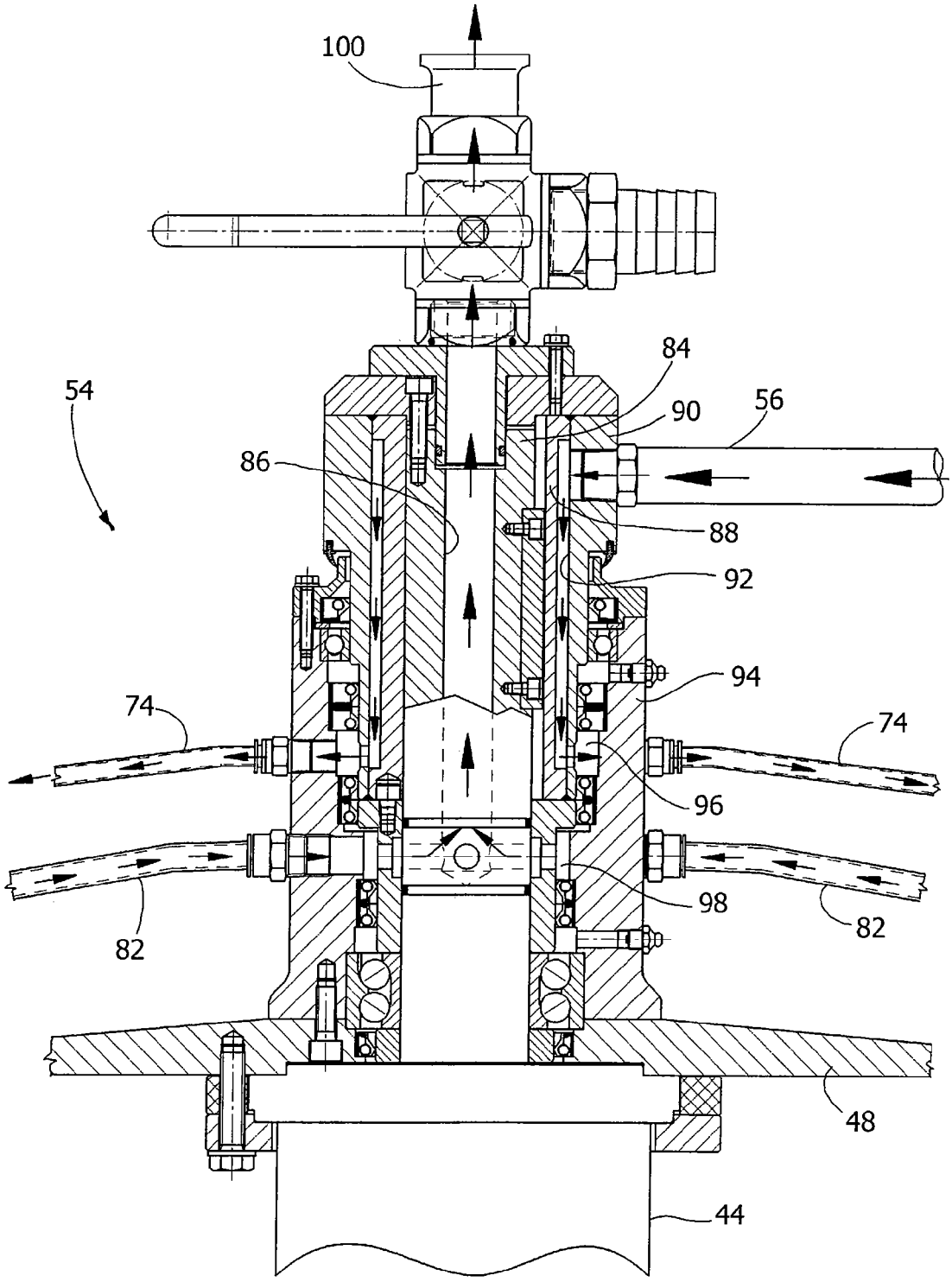

FIG. 4 shows the distribution of the gas flows within the distribution manifold 54. The distribution manifold 54 includes an inner steady hub 84 having a central channel 86. Two concentric elements 88, 90 are fixed with respect to the steady hub 84 and form an annular channel 92 for the distribution of the inert gas flow to the tubes 74 which, in turn, feed the inert gas flow to the various injection heads 46. The element 90 is connected to the tube 56 which feeds to the manifold 54 the inert gas flow coming from the source 58 (FIG. 3).

The distribution manifold 54 includes a rotating body 94 integral with the rotating structure 48 and to which the tubes 74 for the feeding of the gas flow to the distribution heads 46 and the tubes 82 for the return gas flow are connected. The annular channel 92 is connected to the various tubes 74 through a first annular manifold 96 defined between the rotating body 94 and the element 90. The tubes 82 of the return flow are connected to a second annular manifold 98. The second annular manifold 98 is connected to the conduit 86 formed within the steady hub 84, which serves for the exit of the return flow. The conduit 86 is connected through a joint 100 to a tube 102 (FIGS. 1 and 3) for the discharge of the return flow.

Referring to the FIGS. 1 and 2, the bottling machine 10 includes a casing 104 which forms a chamber 106 containing the corking unit 12 and the injection unit 34. The casing 104 includes two extensions 108, 110 which contain the sections 18 and 22 of the conveyor. The casing 104 is equipped with openings 112, 114 for the inlet of the bottles to be corked 20 and for the outlet of the corked bottles 24, respectively. Preferably, the openings 112, 114 are equipped with respective plastic flexible curtains susceptible of bending in order to allow the passage of the bottles through the openings 112, 114.

The casing 104 is associated with a feeding system of inert gas suitable for maintaining in the chamber 106 an inert gas atmosphere. In the example shown in the figures, the feeding system of inert gas includes a tube 150 extending within the casing 104 and which is connected to the source of inert gas 58 through a conduit 152. Preferably, in the casing 104 a device for measuring the oxygen concentration 154 is arranged, which controls the flow rate of inert gas introduced in the casing 104 through a solenoid valve 156.

A second meter of the oxygen concentration 158 is preferably placed outside the casing 104. The second meter 158 is foreseen as a security for the workers and switches on an alarm if the oxygen concentration falls below a pre-established threshold.

Preferably, the casing 104 is associated with a thermoregulation unit 160, for the regulation of the gas temperature contained in the chamber 106. The thermoregulation unit communicates with the chamber 106 through openings formed in the upper wall of the casing 104.

The thermoregulation unit 160 includes a heat exchanger (cooler) 162 and a plurality of fans 164,166. In the example shown in FIG. 1, a first fan draws a gas flow from the upper part of the casing 104. The gas is cooled down by the heat exchanger 162 and reintroduced in the casing 104 by a second fan 166. It can be foreseen a separation wall 168 extending within the chamber 106 for allowing the flow of cooled gas to reach most of the chamber 106, by avoiding a "short circuit" between the flow drawn and the flow emitted from the thermoregulation unit.

The inert gas flow is introduced in the cabin, through the tube 150, at a pressure of about 300 $mmH^2O$, with a varying flow rate, on average in the order of 50 $m_3/h$.

In the chamber 106 there is therefore an inert gas atmosphere with a minimum oxygen residue which can vary from 4% to 7%. This allows that, between the outlet from the injection unit 34 and the time in which the corking in the corking unit 12 is performed, an inlet of oxygen in the bottles to be corked is prevented. At the time in which the corking is performed, in the head portions of the bottles there is an inert gas atmosphere substantially free of oxygen.

The operations of inert gas injection and corking occur without ever performing a suction within the bottles. Therefore, the system according the present invention is particularly suitable for the corking of bottles of sparkling wines, wherein the corking in depression conditions would be particularly harmful as it would cause the emission of foam with a consequent loss of $CO_2$ and reduction of the effervescence.

The system according to the present invention allows a considerable reduction of the oxygen content existing in the bottles after the corking until the value of 80% (from 3 mg/l to 0,5 mg/l). Thanks to this, it is possible to remarkably reduce or eliminate at all the addition of sulfur dioxide or other chemical additives during the bottling step. From the qualitative point of view, it has been shown that the wines with a lower addition of additives are more healthy and, thanks to the decreasing of the total oxygen content in the bottle, more long-lived and softer sparkling wines could be obtained for their lower content of compounds with a bitter taste (phenolic compounds resulting from the oxidation).

Referring to FIGS. 1 and 2, according to a further advantageous feature of the present invention, it is possible to foreseen an inert gas screen in correspondence with the openings 112, 114 which serve for the inlet and the outlet of the bottles from the volume in which the inert gas atmosphere is maintained. The inert gas screens are produced by nozzles 132 fed by the inert gas flow which exits from the injection unit 34 through the conduit 102.

In case the transport of caps is carried out through an aspirator (for example for corks or the like), as the corking unit 12 is placed in an environment saturated with inert gas, also the flow produced by the aspirator can be used for making the screens of inert gas in correspondence with the openings 112, 114. The exhaust flow of the aspirator (not shown) is sent through a conduit 136 to a fan 138 feeds the nozzles 132 through conduits 170. In this case, the exhaust flow of the injection unit 34 is fed to one or both the nozzles 132 together with the exhaust flow of the aspirator.

Figure 6:
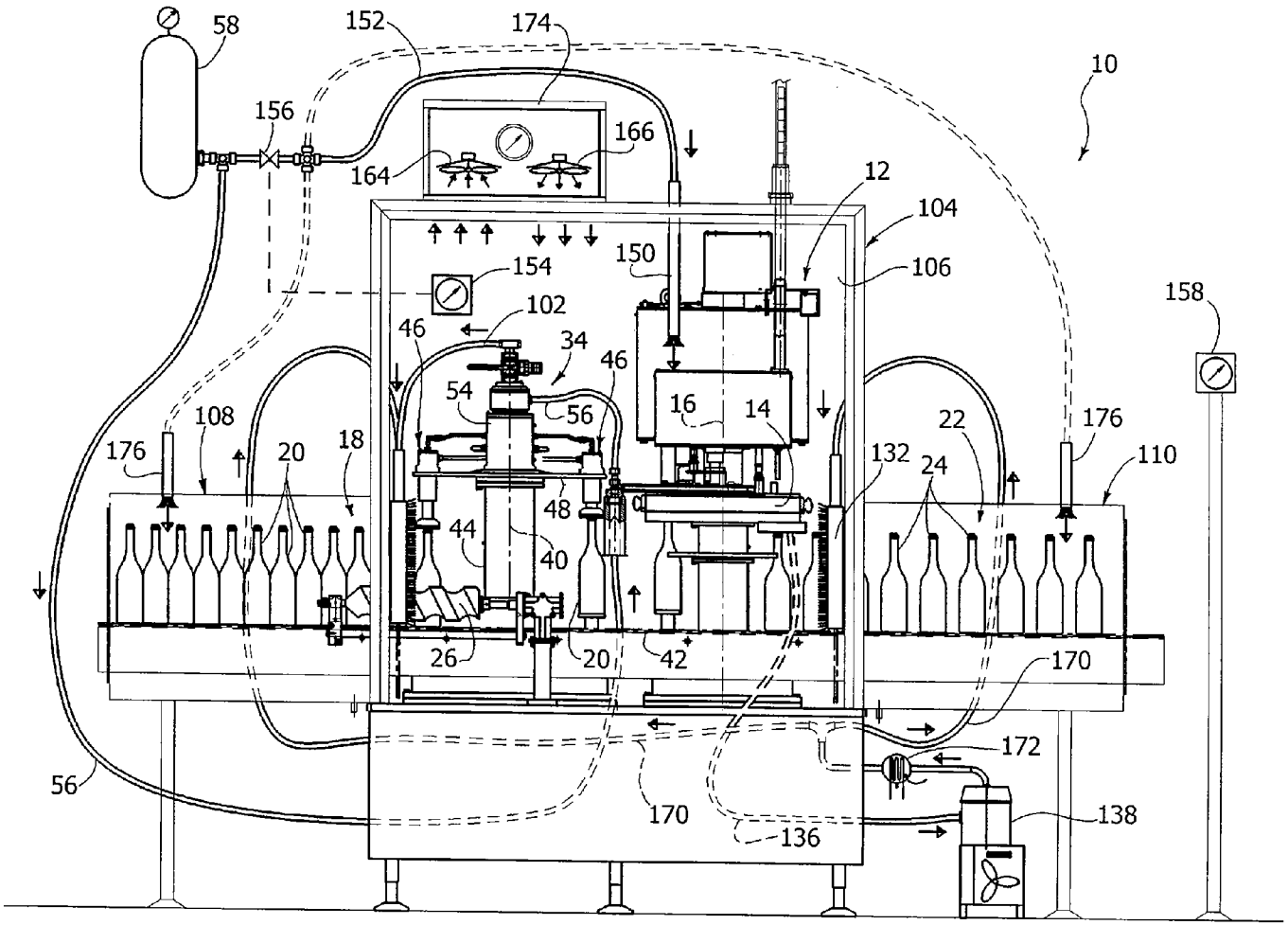
FIG. 6 is a diagrammatic view corresponding to FIG. 1 showing one of the possible variants of the present invention.

In the variant shown in FIG. 6, it is foreseen a heat exchanger 172 (cooler) downstream the fan 138, for cooling down the gas flow sent to the nozzles 132. In this variant, the thermoregulation unit 160 can be replaced by a simple air unit 174 free of cooler, which has only the task of circulating the gas flow in the volume 106. In the variant of FIG. 6 it is also shown the use of two auxiliary nozzles 176 for feeding of inert gas in the extensions 108, 110 of the casing 104. The auxiliary nozzles 176 could of course be used also in the version of FIG. 1.

While the foregoing is directed to embodiments of the present invention, other and further embodiments of the invention may be devised without departing from the basic scope thereof, and the scope thereof is determined by the claims that follow.

The invention claimed is:

1. An automatic machine for closing containers, comprising:

a casing having an inlet opening and an outlet opening;

an automatic corking unit contained inside said casing;

a conveyor including an inlet section for feeding containers inside said casing through the inlet opening and an outlet section for transporting containers outside said casing through said outlet opening;

an inert gas feeding system including a first and a second pipe, the first pipe supplying a first flow of inert gas inside said casing; and an injection unit contained inside said casing and arranged upstream of the corking unit, the injection unit comprising a rotating central hub rotatable about a vertical axis and carrying a plurality of injection heads spaced apart from each other in a circumferential direction, each injection heads including an injection tube having an end portion which, in the use, fits into the head portion of a respective container, a centering element with a surface which, in use, establishes a seal contact with the head portion of a container, and a return conduit for gathering a return gas flow exiting from the head portion of the respective container, the injection unit comprising a distribution manifold arranged co-axially to said rotating hub, the distribution manifold including a stationary inner portion and a rotating outer portion, the stationary inner portion having a first conduit and a second conduit, the first conduit being connected to said second pipe of said inert gas feeding system and the second conduit being connected to a discharge pipe extending outside said casing, wherein the first, the injection unit comprising a first and a second set of connecting tubes connected to the rotating portion of the distribution manifold, the connecting tubes of the first set connecting said first conduit of the distribution manifold to the injection tubes of the injection heads and the second set of connecting tubes connecting the second conduit of the distribution manifold to the return conduits of the injection heads.

2. The machine according to claim 1, wherein the feeding system of inert gas is arranged for maintaining within said chamber a gas atmosphere with an oxygen content lower than a predetermined level.

3. The machine according to claim 1, further including a meter for measuring the oxygen concentration in the chamber, the meter controlling the flow rate of inert gas fed within the chamber.

4. The machine according to claim 3, further including a thermoregulation device including a cooler and a ventilation unit arranged in order to obtain an inert gas circulation within said chamber.

5. The machine according to claim 1, further including inert gas screens in correspondence with said inlet and the outlet openings.

6. The machine according to claim 5, wherein said inert gas screens are fed with an inert gas flow coming from an aspirator of said corking unit.

7. The machine according to claim 5, wherein said inert gas screens are fed with an exhaust gas flow coming from said injection unit.

* * * * *